US007090588B2

(12) United States Patent
Bamber

(10) Patent No.: US 7,090,588 B2
(45) Date of Patent: Aug. 15, 2006

(54) GOLF SWING TRAINING DEVICE

(75) Inventor: Jeffrey V. Bamber, Cincinnati, OH (US)

(73) Assignee: Pelican Golf, Inc., Cincinnati, OH (US)

( * ) Notice: Subject to any disclaimer, the term of this patent is extended or adjusted under 35 U.S.C. 154(b) by 36 days.

(21) Appl. No.: 10/281,558

(22) Filed: Oct. 28, 2002

(65) Prior Publication Data

US 2003/0083140 A1 May 1, 2003

Related U.S. Application Data

(60) Provisional application No. 60/345,369, filed on Oct. 29, 2001.

(51) Int. Cl.
*A63B 69/36* (2006.01)

(52) U.S. Cl. ..... 473/226; 473/227; 473/277

(58) Field of Classification Search ..... 473/226, 473/207, 212, 213, 211, 214, 215, 217, 219, 473/223, 227, 229, 231, 238, 266, 276, 277, 473/204, 275

See application file for complete search history.

(56) References Cited

U.S. PATENT DOCUMENTS

| | | | | | |
|---|---|---|---|---|---|
| 760,161 | A | * | 5/1904 | Smith | 473/294 |
| 1,669,457 | A | * | 5/1928 | Dailey | 473/215 |
| 3,188,086 | A | * | 6/1965 | Parmley | 473/227 |
| 3,190,658 | A | * | 6/1965 | Kane | 473/227 |
| 3,206,200 | A | * | 9/1965 | Butan | 473/62 |
| 3,424,462 | A | * | 1/1969 | Driscoll | 473/238 |
| 3,804,420 | A | | 4/1974 | Boyd | |
| 4,023,812 | A | * | 5/1977 | Lorang | 473/227 |
| 4,059,267 | A | * | 11/1977 | Noble | 473/63 |
| 4,145,054 | A | * | 3/1979 | Stewart | 473/227 |
| 4,170,356 | A | * | 10/1979 | Banks | 473/227 |
| 4,257,607 | A | * | 3/1981 | Nedwick | 473/212 |
| 4,637,612 | A | * | 1/1987 | Wilkins | 473/215 |
| 4,682,775 | A | * | 7/1987 | Wood | 473/227 |
| 4,944,516 | A | * | 7/1990 | Bickler | 473/227 |
| 5,152,532 | A | * | 10/1992 | Rouse | 473/213 |
| 5,156,399 | A | * | 10/1992 | Gauer | 473/205 |
| 5,203,568 | A | * | 4/1993 | Vasquez | 473/212 |
| 5,294,126 | A | | 3/1994 | Armstrong, III | |
| 5,390,928 | A | * | 2/1995 | Salini | 473/205 |
| 5,465,971 | A | * | 11/1995 | Tischler | 473/227 |
| 5,658,205 | A | | 8/1997 | Bartscherer | |
| 5,759,111 | A | | 6/1998 | Clark | |
| 5,846,143 | A | * | 12/1998 | Brock et al. | 473/409 |
| 5,879,240 | A | * | 3/1999 | Stuart | 473/215 |

(Continued)

OTHER PUBLICATIONS

Jim McLean, Breaking 100-90-80, Golf Digest, Oct. 2001, p. 170, vol. 52, No. 10, The Golf Digest Companies, Trumbull, CT, U.S.A.

(Continued)

*Primary Examiner*—Nini F. Legesse
(74) *Attorney, Agent, or Firm*—Jeffrey V. Bamber

(57) ABSTRACT

Golf swing training devices are disclosed. The swing training devices can be used during practice, during play, or both. In one non-limiting embodiment, the swing training device can be used by the golfer to ensure that he or she stands the correct distance from the golf ball at address. In another non-limiting embodiment, the swing training device comprises an element that is sized and configured for making contact with at least a portion of a golfer's body during a golf swing to ensure that the golfer swings his or her arms properly on the backswing, the downswing, or both.

14 Claims, 2 Drawing Sheets

U.S. PATENT DOCUMENTS

| | | | | |
|---|---|---|---|---|
| 5,904,624 | A * | 5/1999 | Martinez | 473/212 |
| 5,919,097 | A * | 7/1999 | Cole | 473/212 |
| 5,941,780 | A | 8/1999 | Marier, Jr. | |
| 5,976,024 | A * | 11/1999 | Marshall, Jr. | 473/227 |
| 6,196,930 | B1 | 3/2001 | Aumock | |
| 6,251,025 | B1 * | 6/2001 | Brock et al. | 473/227 |
| 6,293,875 | B1 | 9/2001 | Sanford | |
| 6,447,402 | B1 | 9/2002 | Moran | |
| 6,458,036 | B1 | 10/2002 | Gutierrez | |
| 6,471,598 | B1 | 10/2002 | Takase | |
| 6,491,591 | B1 * | 12/2002 | Schuster | 473/212 |
| 6,503,148 | B1 | 1/2003 | Lane | |
| 6,530,845 | B1 | 3/2003 | Corbett | |
| 6,533,676 | B1 * | 3/2003 | D'Angelo et al. | 473/239 |
| 6,582,318 | B1 * | 6/2003 | Halfacre | 473/215 |

OTHER PUBLICATIONS

Albert Yaghoubi, Use a Cell Phone to Fix the Downswing, Golf Digest, Nov. 2001, p. 85, vol. 52, No. 11, The Golf Digest Companies, Trumbull, CT, U.S.A.

Author Unknown, Golf Swing Teaching Jacket, Hammacher Schlemmer catalog, Gift 2001, p. 16, Hammacher Schlemmer & Co., Inc., NY, NY, U.S.A. (It is believed that this device has been marketed for several years.).

* cited by examiner

GOLF SWING TRAINING DEVICE

This application claims the benefit of the filing date of U.S. provisional patent application Ser. No. 60/345,369, filed Oct. 29, 2001.

FIELD OF THE INVENTION

The present invention relates to golf swing training devices, and includes swing training devices that can be used during practice, during play, or both.

BACKGROUND OF THE INVENTION

The golf swing starts out from an "address" position. The golf swing then involves a backswing and a downswing. One problem for average golfers is to stand the correct distance from the golf ball at address. Another problem is to ensure that the arms swing properly on the backswing and the downswing. It is believed to be desirable for golfers to swing their arms close to their body on the downswing portion of a golf swing. When a golfer is swinging, however, it is difficult to tell how well they are able to achieve this objective.

U.S. Pat. No. 6,293,875 B1 issued to Sanford is directed to a golf swing training aid that permits the user to verify that the face of the golf club has not been inadvertently rotated during the backswing and/or the downswing of a golf swing. The Sanford device consists of a planar flag portion that is attached to the end of a stem portion. The stem portion is fit into the vent hole of the grip on the end of the golf club. The Sanford patent states that the swing training aid described therein can be made of metal, plastic, or another material having sufficient rigidity. When the Sanford device is on the golf club, the device is used to allow the golfer to check the position of their club face by looking at the flag portion of the device. The object is to allow the golfer to check the club face orientation without rotating his or her head. The Sanford patent teaches nothing about providing a mechanism for training golfers to position their arms and/or hands a certain distance from their body before or during their swing.

Thus, there is a need to provide improved and different types of golf swing training devices.

SUMMARY OF THE INVENTION

The present invention relates to golf swing training devices, and includes swing training devices that can be used during practice, during play, or both.

There are numerous, non-limiting embodiments of the invention. All embodiments, even if they are only described as being "embodiments" of the invention, are intended to be non-limiting (that is, there may be other embodiments in addition to these), unless they are expressly described as limiting the scope of the invention.

In one non-limiting embodiment, the swing training device can be used by the golfer to ensure that he or she stands the correct distance from the golf ball at address.

In another non-limiting embodiment, the swing training device comprises an element that is sized and configured for making contact with at least a portion of a golfer's body during a golf swing. The swing training device, in such an embodiment, can be positioned on or joined to various portions of the golfer's golf equipment, the golfer's clothing, or the golfer's body. The swing training device can, for example, be positioned on or joined to the golfer's golf club; or be positioned on or joined to the golfer's golf glove. In another non-limiting example, the swing training device can be positioned on the golfer's clothing, such as the golfer's belt. In yet another non-limiting example, the swing training device can be positioned on the golfer's body, such as on a band that is worn on a portion of the golfer's arm.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE INVENTION

Figure 1:
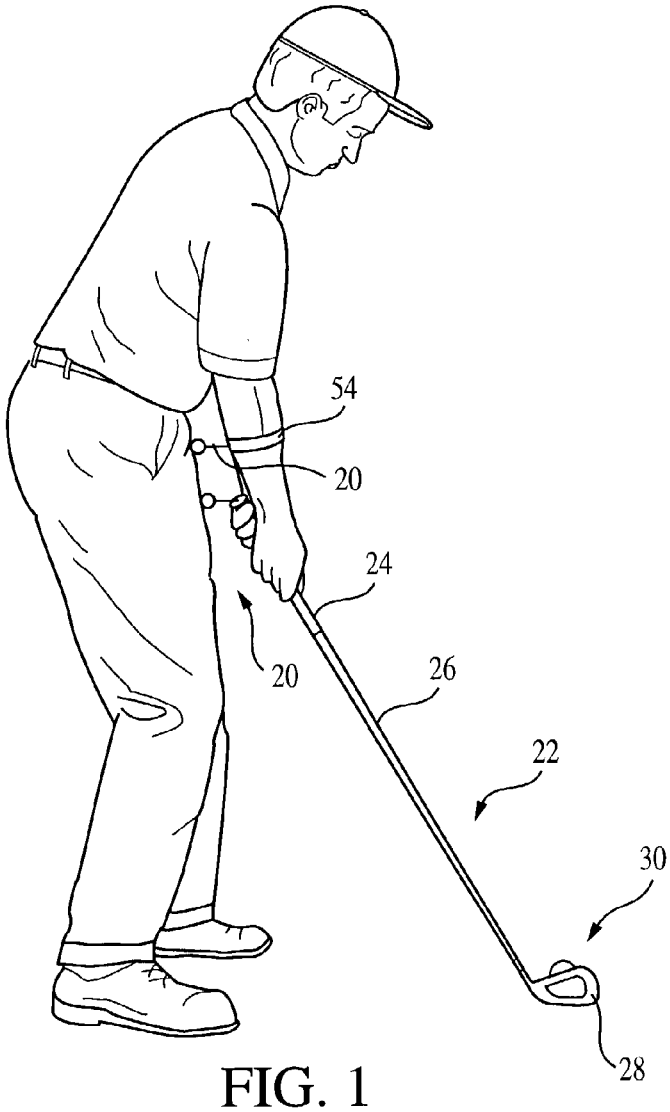
FIG. 1 is a side view of a golfer using two non-limiting embodiments of the swing training device of the present invention.

The present invention relates to golf swing training devices, and includes swing training devices that can be used during practice, during play, or both.

The drawings illustrate a non-limiting number of variations of the golf swing training device. Even though only a few examples of the golf swing training device are shown in the drawings, it should be understood that the swing training device 20, in any of the embodiments described herein, can be positioned on or joined to various other portions of the golfer's golf equipment, the golfer's clothing, or the golfer's body. The swing training device can, for example, be positioned on or joined to the golfer's golf club; or be positioned on or joined to the golfer's golf glove. In another non-limiting example, the swing training device can be positioned on the golfer's clothing, such as the golfer's belt. In yet another non-limiting example, the swing training device can be positioned on the golfer's body, such as on a band that is worn on a portion of the golfer's arm.

In addition, even though golf swing training device is shown as having a particular configuration in the drawings, it should be understood that the golf swing training device is not limited to devices having the particular configuration(s) shown in the drawings, and that it can be of any configuration suitable for carrying out its purpose. The present invention is defined only by the appended claims, and is not intended to be limited by the specification, or limited to the embodiments shown in the drawings.

FIG. 1 shows one non-limiting embodiment of a golf swing training device 20 joined to a golf club 22. The golfer shown in FIG. 1 can either be in an "address" position, or at a point in his downswing when he is striking a golf ball with golf club 22. The golf club 22 comprises a grip 24, a shaft 26, and a club head 28. The grip 24 covers the end of the golf club shaft 26 that is held by the golfer. The club head 28 has a club face 30 for striking the golf ball. The golf swing training device 20 shown in FIG. 1 can be used for a number of purposes by the golfer. The embodiment of the golf swing training device 20 shown in FIG. 1 can be used by the golfer to ensure that he or she stands the correct distance from the golf ball at address. In addition, or alternatively, the golf swing device 20 can be used during the golfer's backswing and/or downswing.

Figure 2:
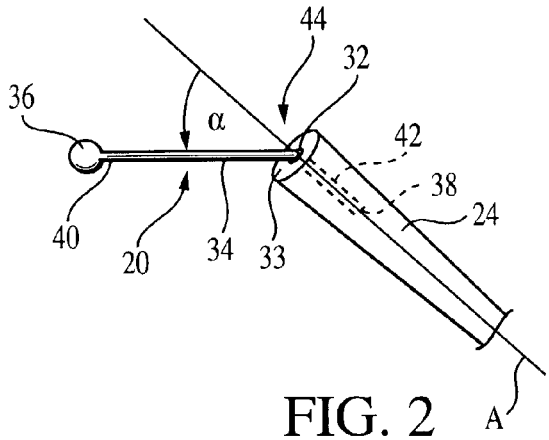
FIG. 2 is an enlarged fragmentary side view of a portion of the end of the grip on the golf club with one embodiment of the swing training device joined thereto.

FIG. 2 shows a portion of the end of the grip 24 on the golf club 22 with the swing training device 20 joined thereto temporarily, or permanently. The term "joined to", as used herein, includes, but is not limited to: two or more elements that are directly attached together; two or more elements that are indirectly attached to each other, such as by virtue of being connected to one or more other elements; and two or more elements that are integral parts of a structure. The term "joined" is not limited to relationships in which the elements touch. The golf club shaft 26 has an axis, A, that extends through the grip 24. The grip 24 may have a vent hole 32 at the end of its butt portion 33.

The embodiment of the swing training device 20 shown in FIGS. 1 and 2 comprises an element that is positioned on or joined to the golfer's golf club 22 and extends toward the golfer's body. In the embodiment shown in FIGS. 1 and 2, the swing training device 20 comprises a stem portion 34 and a distal portion 36. The stem portion has two ends, a proximal end 38 and a distal end 40. The stem portion 34 in this particular embodiment comprises a proximal portion 42 that includes the proximal end 38 and is inserted into the vent hole 32 in the golf club grip 24. The stem portion 34, in this embodiment, also has a bend 44 therein. The bend 44 is located at the place where the stem portion 34 extends from the vent hole 32 in the butt 33 of the grip 24.

In the embodiment shown, the part of the stem portion 34 that extends rearwardly from the grip 24 has at least a portion or a component that lies below the extension of the longitudinal axis, A, of the shaft 26 (beyond the butt portion of the grip 24). More specifically, this part of the stem portion 34 lies below the extension of the longitudinal axis A of the shaft when the golf club is in address position with the sole of the club head lying flat on the ground. The part of the stem portion 34 that extends from the grip 24 forms an angle $\alpha$ with the longitudinal axis, A, of the shaft 26 of the golf club 22. In one non-limiting embodiment, the angle $\alpha$ is such that the part of the stem portion 34 that extends from the grip 24 is approximately parallel to the ground.

Figure 3:
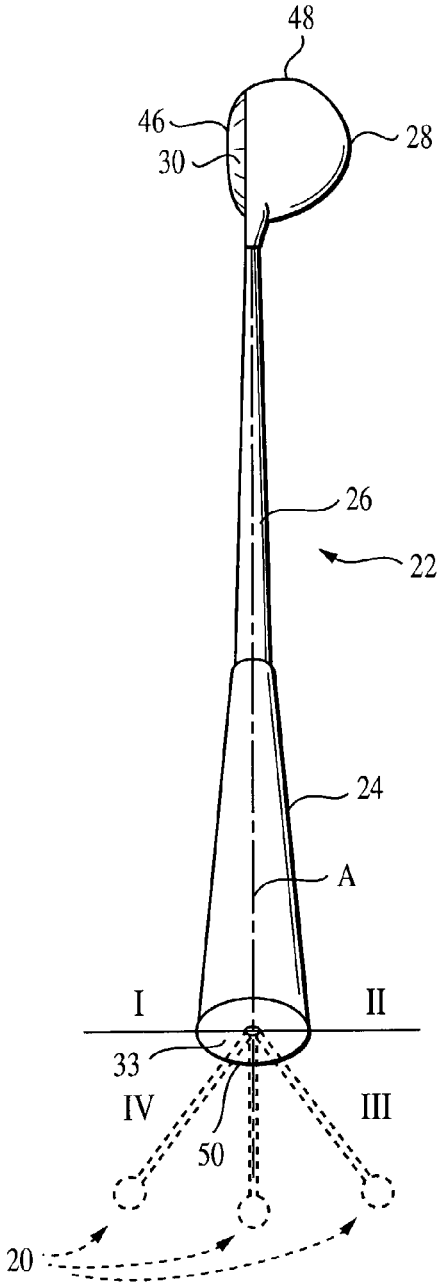
FIG. 3 is a perspective end view of a golf club showing different angles that the swing training device can make relative to the club face.

While the part of the stem portion that extends rearwardly from the grip 24 in FIGS. 1 and 2 extends directly back in the same vertical plane as the golf club shaft (and generally parallel to the club face), other orientations are possible. FIG. 3 shows several non-limiting embodiments of the different angles that the swing training device 20 can make relative to the club face 30. FIG. 3 shows that there can be four possible 90 degree segments around the butt of the grip 24 when the grip is viewed from the end. These areas are designated, proceeding clockwise around the butt of the grip shown in FIG. 3 a first 90 degree segment I, a second 90 degree segment II, third 90 degree segment III, and fourth 90 degree segment IV.

The first 90 degree segment I is bounded by a plane that extends forward of and generally at right angles to the lower leading edge 46 of the club head 30 (i.e., generally toward the target) to a plane which extends toward the toe 48 of the club head in a direction generally parallel to the lower leading edge 46 of the club head. The second 90 degree segment II is bounded by the plane which extends toward the toe 48 of the club head in a direction generally parallel to the lower leading edge 46 of the club head to a plane that extends rearwardly (away from the target) generally at right angles to the lower leading edge of the club head. The third 90 degree segment III is bounded by the plane which extends rearwardly generally at right angles to the lower leading edge of the club head to a plane that extends outwardly from the portion of the butt 33 of the grip that aligns with the underside 50 of the grip 24 in a direction opposite the toe 48 of the club head generally parallel to the lower leading edge of the club head (i.e., generally toward the golfer's body). The fourth 90 degree segment IV is bounded by the plane which extends outwardly from the portion of the butt 33 of the grip that aligns with the underside 50 of the grip 24 in a direction opposite the toe of the club head generally parallel to the lower leading edge of the club head to the plane that extends forward of and generally at right angles to the lower leading edge of the club head.

In the embodiment shown in the drawings, the swing training device 20 has a stem-like structure 34 and a rounded distal portion 36. The swing training device 20, however, is not limited to configurations having a stem-like structure and a rounded distal portion. The swing training device 20 can have any configuration suitable for carrying out its desired purpose.

The different portions of swing training device 20 can have physical properties that range from flexible to rigid. The different portions of the swing training device 20 can have different flexibilities, or other differing physical properties. The swing training device can be similar in construction to a "curb feeler" that used to be seen on some automobiles. In such an embodiment, the stem portion 34 of the swing training device 20 may be flexible, and the distal portion 36 may be more rigid. In this particular embodiment, the swing training device 20 is long enough so that it will touch the golfer's body. In addition, different parts of the same portion of the swing training device 20 may have different physical properties. For instance, it may be desirable for the proximal portion 42 of the stem portion 34 to be more rigid than that portion of the stem portion 34 extending outward from the end of the grip 24 of the golf club 22.

The swing training device 20 can be made of any suitable material, including but not limited to rubber, plastic, metal, or combinations thereof. In one non-limiting embodiment, the swing training device 20 can have a metal stem portion, and a plastic or rubber distal portion on the end adjacent to the golfer's body. The distal portion can be rounded, such as in the nature of a ball. This will provide the golfer with a noticeable, but comfortable feel when the swing training device 20 touches the golfer's body.

The swing training device 20 can be made by any means known in the art. In one non-limiting embodiment, the swing training device 20 can be made by selecting and cutting a length of metal from an article such as a wire clothes hanger, or the like and forming that metal piece into the desired configuration for the stem portion 34. The distal end 40 of the stem portion 34 can be inserted into a ball made of rubber, foam, etc. to form the rounded distal portion 36 of the swing training device 20. In other non-limiting embodiments, the swing training device 20, or any suitable portion thereof, can be molded out of a plastic material. The proximal portion 42 of the swing training device 20 can be inserted into the vent hole 32 of the grip 24. If the proximal portion 42 of the swing training device is smaller in cross-section than the vent hole 32, the proximal portion 42 can be wrapped with any suitable material to make it fit snugly into the vent hole 32. Alternatively, the proximal portion 42 can be secured in the vent hole 32 by adhesives, or some other suitable substance.

In one non-limiting embodiment, the swing training device 20 is used by inserting the proximal end 38 of the stem portion into the vent hole 32 of the grip 24 on a golf club as described above. If the swing training device 20 is intended to be used by the golfer to ensure that he or she stands the correct distance from the golf ball at address, the swing training device 20 can be oriented so that when viewed from above the butt end 33 of the grip 24, the stem portion 34 extends directly back toward the golfer's body in the same vertical plane as the golf club shaft 26. If the swing training device 20 is intended to be used by the golfer to ensure that the arms swing properly on the backswing, the same orientation will also work. If the swing training device 20 is intended to be used by the golfer to ensure that the arms swing properly on the downswing, the swing training device 20 can be oriented so that it is in the third 90 degree segment, III, in FIG. 3. The golf swing training device 20 is, however, not limited or restricted to being in the orientations described herein for such purposes.

The swing training device 20 can be provided in a non-limiting number of embodiments, and with a non-limiting number of additional features.

In other embodiments, for example, the swing training device 20 need not be inserted into the vent hole 32 of a grip 24. The swing training device 20 can be inserted into, or joined to, any other suitable portion of the grip 24 or shaft 26, including along a portion thereof that lies outside the outer wall of the golf club shaft 26. In other embodiments, the swing training device 20 can be joined to the outside of the grip 24. The swing training device 20 can be joined to the outside of the shaft or grip in any manner known for joining two components together.

The bend 44 in the stem portion 34, if one is present, is not limited to being located at the place where the stem portion 34 extends from the vent hole 32 in the butt 33 of the grip 24. It can be located at any suitable place along the length of the stem portion 34. In other embodiments, the stem portion 34 may have some other configuration, such as a gradual curvature, so that a bend is not necessary.

Figure 4:
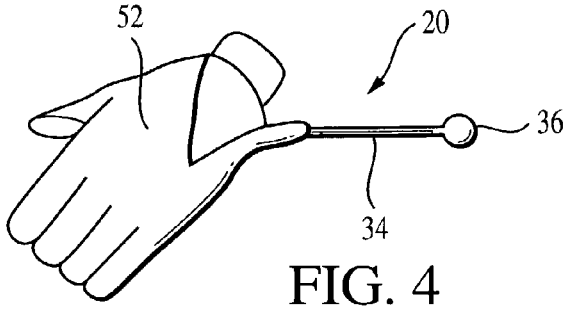
FIG. 4 is a side view showing another non-limiting embodiment of the swing training device in which the swing training device is attached to the golfer's golf glove.

The swing training device 20 need not be attached to the grip of a golf club. In another embodiment shown in FIG. 4, the swing training device 20 is attached to the golfer's golf glove 52.

FIG. 1 also shows another non-limiting embodiment of the swing training device in which there is an upper swing training device 20 that is attached to a band 54 worn on the golfer's arm. There are a non-limiting number of variations of this embodiment. In one non-limiting variation, the band can be worn on the golfer's right arm, such as on the golfer's right elbow. The distal portion of the swing training device can be oriented so that it is close to the golfer's right hip on the downswing to detect how close the golfer's right elbow comes to his or her right hip on the downswing.

In another non-limiting variation, the band 54 can be worn on the golfer's left arm, such as on the golfer's left elbow, to allow the golfer to ensure, such as by brushing the golfer's chest, that his left arm returns to the address position when the club impacts that golf ball. The positions of the swing training device 20 would, of course, be reversed for left handed golfers. The stem portion of the golf training device 20 in such embodiments can be oriented in any of the various segments around the golfer's arm similar to the segments I–IV that are shown in FIG. 3 for the swing training device 20 that is mounted on the grip of a golf club.

Multiple swing training devices of the same or different types can be used at the same time for various different purposes. For example, in one non-limiting embodiment, more than one swing training device extending out of the grip can be used to sequentially contact different portions of the golfer's body. For instance, multiple swing training devices can be used to contact a portion of the golfer's body, such as one of the golfer's thighs, or portion thereof, and to contact another one of the golfer's thighs, or portion thereof (or, in another non-limiting example, different portions of the same thigh) for various different purposes. In one non-limiting embodiment, such multiple swing training devices can be used to ensure that the golfer's hands rotate properly through the impact zone. These different types of swing training devices described herein (e.g., club mounted devices, arm mounted devices, etc.) can also be combined in any way to train the golfer to make the correct sequence of movements and/or achieve the correct positions with their arms or other portions of their body at various points during the golf swing.

The swing training device 20 can be made adjustable in length (spring, telescoping) so that it can be adapted to work with different size golfers. The swing training device 20 can be sold with instructions that tell the golfer the proper size to adjust the length of the swing training device for golfers of different sizes.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the subject invention have been described, it will be obvious to those skilled in the art that various changes and modifications of the subject invention can be made without departing from the spirit and scope of the invention. It will be clear to those skilled in the art that various changes and modifications may be made without departing from the scope of the invention and the invention is not to be considered limited to the embodiments and examples that are described in the specification.

What is claimed is:

1. A golf swing training device for use by a golfer, said golf swing training device comprising an element that is attached to a golf club, said golf club having a club head, a shaft, and a grip, said club head having a club face and an opposed back surface, said shaft having an axis, and said grip having a butt end, wherein said element extends rearwardly beyond the butt end of the grip of the golf club in a direction generally opposite to the end of the club with the club head so that when the club head is grounded in position to address a golf ball and the golf club is viewed from the side corresponding to either the club face or the back of the club head, at least a portion of said element is disposed below an extension of the axis of the shaft from butt end of the grip of the golf club, and said element has a length and extends in a such a direction that a portion of said swing training device touches at least a portion of a golfer's body that is located at or below the golfer's waist, and is a portion of the golfer's body other than the golfer's arms or hands, wherein said portion of the swing training device that touches such a portion of the golfer's body does so when the golfer is at address position, or intermittently when the golfer properly executes a golf swing, or at both address and intermittently during a properly executed swing.

2. The golf swing training device of claim 1 wherein the device has such a length and configuration that it touches one of the golfer's legs when the golfer is at address position, during the golfer's swing, or both.

3. The golf swing training device of claim 2 wherein the golf club comprises a shaft and a grip, said grip having a vent hole, and the golf swing training device is joined to the grip of the golf club.

4. The golf swing training device of claim 3 wherein the golf swing training device is inserted into the vent hole in the grip of the golf club.

5. The golf swing training device of claim 2 wherein the golf club comprises a shaft and a grip, and the golf swing training device is joined to the shaft of the golf club.

6. The golf swing training device of claim 1 comprising at least a portion which is flexible.

7. The golf swing training device of claim 1 further comprising a stem portion and a distal portion.

8. The golf swing training device of claim 7 wherein the stem portion is flexible, and the distal portion is more rigid than at least a portion of the stem portion.

9. The golf swing training device of claim 7 wherein the distal portion is rounded.

10. The golf swing training device of claim 1 wherein said swing training device has a length that establishes a specific distance that the golfer should stand from a golf ball when the golfer is addressing the golf ball.

11. The golf swing training device of claim 10 wherein said device is adjustable in length.

12. The golf swing training device of claim 10 further comprising a stem portion and a distal portion, wherein the shaft of the golf club has a longitudinal axis, and at least part of the stem portion of the device lies below the extension of the longitudinal axis of the shaft beyond the butt of the grip of the golf club when the golf club is in address position with the sole of the club head lying flat on the ground.

13. The golf swing training device of claim 12 wherein at least a portion of said device extends in a direction that is generally parallel to the surface of the ground when the golf club is in the address position.

14. The golf swing training device of claim 1 wherein said swing training device has a length that establishes a specific distance that the golfer's arms swing away from the golfer's body during at least a portion of the swing.

* * * * *